United States Patent [19]

Speller, Jr.

[11] 3,964,545

[45] June 22, 1976

[54] PROCESSES FOR SECONDARILY RECOVERING OIL

[75] Inventor: Frank N. Speller, Jr., Tyler, Tex.

[73] Assignee: Esorco Corporation, Boston, Miss.

[22] Filed: June 10, 1974

[21] Appl. No.: 477,846

Related U.S. Application Data

[63] Continuation-in-part of Ser. No. 309,063, Nov. 24, 1972, abandoned.

[52] U.S. Cl. ..... 166/256; 166/251; 166/266; 166/268

[51] Int. Cl.[2] ..... E21B 43/00; E21B 43/24

[58] Field of Search ..... 166/256, 260, 261, 266, 166/245, 268, 272

[56] References Cited

UNITED STATES PATENTS

| | | | |
|---|---|---|---|
| 2,630,307 | 3/1953 | Martin | 166/251 |
| 2,642,943 | 6/1953 | Smith et al. | 166/261 |
| 2,718,263 | 9/1955 | Heilman et al. | 166/261 X |
| 2,771,951 | 11/1956 | Simm | 166/256 |
| 2,818,117 | 12/1957 | Koch | 166/256 |
| 3,019,837 | 2/1962 | Marx et al. | 166/256 |
| 3,032,102 | 5/1962 | Parker | 166/256 X |
| 3,072,185 | 1/1963 | Bond et al. | 166/261 |
| 3,174,543 | 3/1965 | Sharp | 166/256 |
| 3,205,944 | 9/1965 | Walton | 166/261 |
| 3,209,825 | 10/1965 | Alexander et al. | 166/245 |

*Primary Examiner*—Stephen J. Novosad
*Attorney, Agent, or Firm*—Mann, Brown & McWilliams

[57] ABSTRACT

A secondary recovery process using injected air to pressurize the formation and maintain mobility of the reservoir oil by diluting the oil with carbon dioxide. Carbon dioxide is produced as a by-product of air injection, either by auto-oxidation of carbonaceous materials in the reservoir rock, or by ignition of oil in the reservoir. Efficiency of oxidation is observed by testing $O_2$ content of the effluent gas; it is desirable to hold the oxygen content in the effluent gas to less than 3% by volume in the effluent gas. When this content cannot be reached by auto-oxidation, it is necessary to ignite the oil.

5 Claims, 1 Drawing Figure

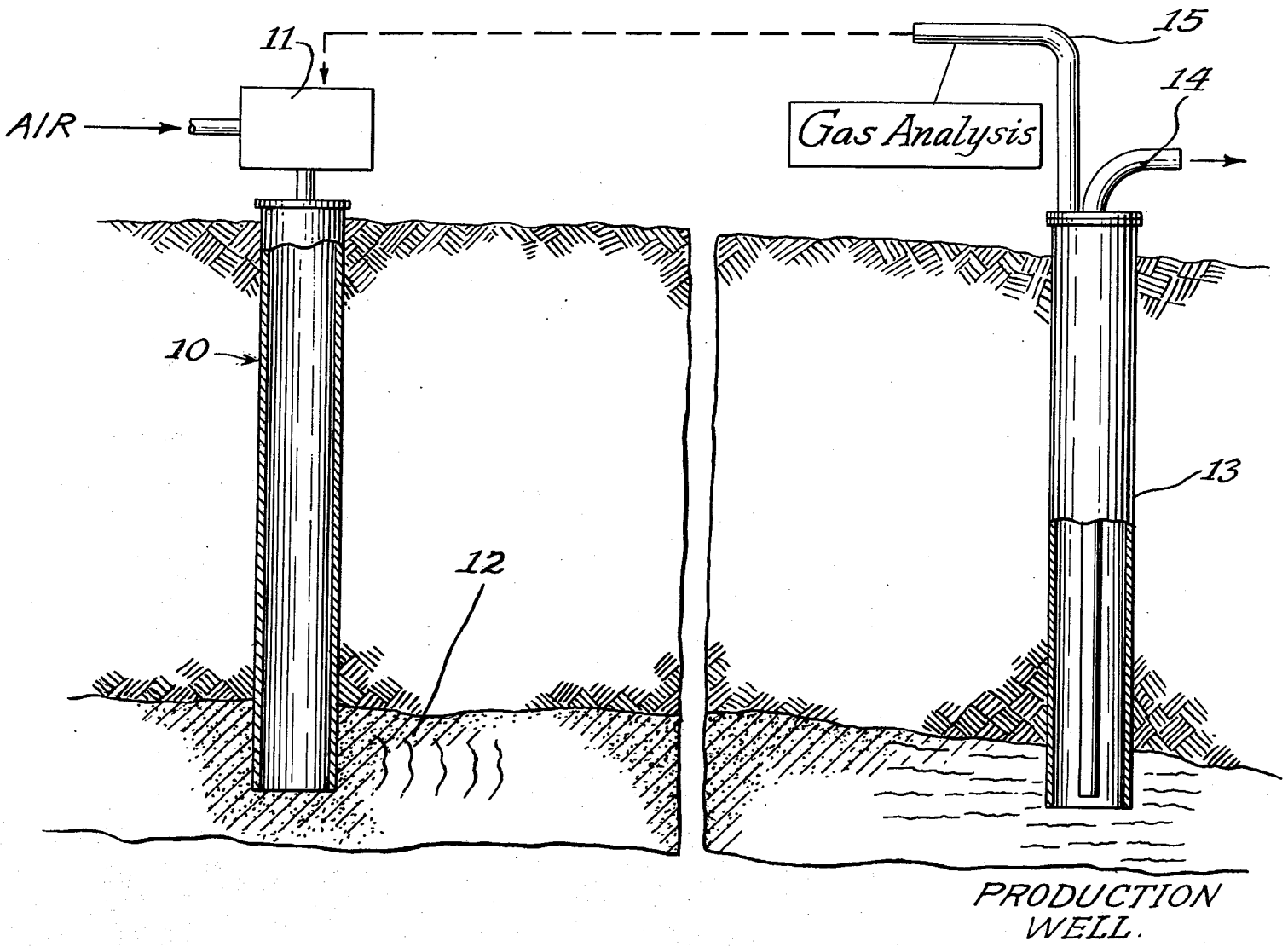
15
14
13
Gas Analysis
PRODUCTION WELL.
12
11
10
AIR

PROCESSES FOR SECONDARILY RECOVERING OIL

This application is a continuation-in-part of copending application, Ser. No. 309,063, filed Nov. 24, 1972, now abandoned.

The present invention is directed to improvements in processes for secondary recovery of oil.

A number of secondary recovery processes for the recovery of oil from oil bearing sands are known. In the past, water flooding techniques have been utilized in order to drive oil towards a producing well. "Fire flood" processes are also known in which combustion is initiated underground to increase the temperature and thereby reduce the viscosity of the oil and the adhesion of the oil to the reservoir sand to thereby promote flow of the oil toward a producing well. In some cases, carbon dioxide with or without hydrocarbon gases has been utilized in connection with water flood processes to promote the flow of oil toward a recovery well. It has also been known to utilize butane, propane, and equivalent hydrocarbon gases under relatively high pressures, for example, exceeding 2,000 p.s.i. in a water or gas mixture for driving oil from the oil bearing sands to a producing well. Air injection processes which produce oxidation without ignition and low pressure gas injection techniques have also been proposed in secondary recovery processes.

Water flooding techniques can be economically effective in some cases. Use of carbon dioxide in water flooding techniques increases equipment corrosion to the extent that the economics of the overall operation may be unsatisfactory. Fire flood techniques are satisfactory in some cases, but in other cases, a fire flood operation is not economical, because of the extent and intensity of burning necessary to produce a given amount of oil. The use of injected gas mixtures at high pressures has the disadvantage of the high cost of the gases so used. The high pressures utilized with gas injected mixtures usually require plugging of those wells of the field which are not operative in the process in order to maintain the high pressures and to avoid contamination of the atmosphere. Previous air injection processes have been satisfactory in some cases, but these processes have not reduced oil adhesion as much as fire flood or carbon dioxide processes. Low pressure gas injection can be satisfactory to promote oil flow in some cases, but the low pressures may not be sufficient to drive oil to a production well in some formations and the gas supply may not be sufficient for production.

With the foregoing in mind, the present invention is directed to a new, improved and economical process for secondary recovery of oil. The major purpose of the invention is to provide an economic method for secondary recovery of oil, while utilizing injected air to both pressurize a formation and to initiate an oxidation reaction with the well material which produces an effluent gas including components of $CO_2$ and $O_2$. The $CO_2$ produced goes into solution in the reservoir oil to reduce surface tension of the oil to the reservoir sand thereby rendering it more mobile and susceptible of being driven to a producing well. The present invention additionally results in the economic manufacture of carbon dioxide as a by-product of the process.

This and other purposes will appear from time to time in the course of the ensuing specification and claims when taken in conjunction with the accompanying drawing which is a diagram of the process constituting the present invention.

In accordance with the present invention, the formation is pressurized with injected air. As shown in the drawing, for example, the numeral 10 designates an injection well into which a suitable compressor or the like 11 delivers air to the bottom of the well for the purpose of pressurizing the formation. Air is delivered in a volume and at a pressure such as to maintain a reservoir pressure of at least 500 p.s.i.g.

The drive produced by the injected air causes oil in the reservoir to flow towards production well 13. Production well 13 includes suitable tubing and pumping facilities 14 for withdrawing oil and gas; additional effluent gas is withdrawn through the casing 15.

In secondary recovery processes, the mobility of the oil decreases as oil is withdrawn from the producing well or wells. As oil is withdrawn, reservoir pressure drops because of voids in the reservoir. The purpose of maintaining reservoir pressure of at least 500 p.s.i.g. is to hold in solution those heavier hydrocarbon components of the original solution gas which in most high-gravity, paraffin-base oils constitute over 10% of the reservoir oil volume. It is well known that their release from the reservoir oil tends to increase the oil viscosity and change the surface tension of the oil to the reservoir rock thereby rendering the oil less mobile. By flowing air to the reservoir and maintaining pressure in the reservoir through use of the injected air, the pressure lost through oil and gas withdrawals from the producing well or wells can be balanced by the injected air.

In accordance with the invention, the injected air is at a pressure and volume such as to cause an oxidation reaction with the carbonaceous well materials. This oxidation reaction produces an effluent gas which includes components of carbon dioxide and oxygen and additional gases which will be described later. The majority of $CO_2$ produced dissolves in the reservoir oil. The dissolved carbon dioxide not only improves mobility of oil, but also forces the oil into the more permeable flow channels by swelling the oil.

In those cases where the reservoir rock contains sufficient carbonaceous materials, auto-oxidation of the rock alone will create the desired carbon dioxide. In other cases wherein the amount of reservoir carbonaceous materials is not sufficient, carbon dioxide is produced underground by igniting the oil and gas adjacent to the injection well 10, in accordance with known fire flood techniques, thereby producing carbon dioxide which may go into solution with the oil in the reservoir to improve its mobility.

Unexpectedly, it is extremely important in this process to maintain the oxidation reaction at its most efficient level. Such a level can be determined by a measure of the level of oxygen by volume in the effluent gas removed from the well. When the oxygen level is less than 3% the oxidation reaction is operating at its most efficient rate. Control of the oxygen content at less than 3% will hold the volume of carbon dioxide in the effluent gas at greater than 15% and preferably around 18%.

The carbon dioxide produced by the oxidation reaction goes into solution in the reservoir oil and maintains it in a mobile state. This assists in driving the oil towards the production well 13. When the oil is separated from the effluent gas at the production well the carbon dioxide previously dissolved comes out of solution and rejoins the other components of the effluent gas.

One typical analysis of effluent gas reads as follows:

| | |
|---|---|
| Methane | 6.01% by volume |
| Ethane | 2.05 |
| Carbon Dioxide | 16.62 |
| Oxygen | 2.94 |
| Helium | 0.01 |
| Nitrogen | 60.93 |
| Propane | 4.86 |
| Isobutane | 1.14 |
| Normal Butane | 3.26 |
| Isopentane | 0.73 |
| Normal Pentane | 0.87 |
| Heptane | 0.45% by volume |
| Heptane + | 0.13 |

The heating value of this gas is rated at 456 BTU and has a specific gravity of 1.14.

During the initial use of the process, effluent gas withdrawn through the casing 15 and separated from the oil produced through tubing 14 by an oil-gas separator at the tank battery may economically be recovered and sold as long as the methane and ethane content of this gas is sufficiently high. The effluent gas may also be used for recycling through the formation by either passing it down injection well 10, as indicated by the arrow in FIG. 1, or by injecting it in an additional well. The effluent gas so injected adds a component of carbon dioxide to the reservoir for the purposes heretofore described.

The oxidation reaction may be maintained at its most efficient level, as indicated by an oxygen content of less than 3% by volume of the effluent gas, by a constant monitoring of the oxygen content of the effluent gas removed from the well. The drawing indicates gas analysis means associated with the casing 15 which is provided to periodically analyze the $O_2$ content of the gas removed. As long as the $O_2$ content remains below 3% the oxidation reaction is proceeding efficiently and sufficient carbon dioxide is being produced in the reservoir. This, along with the reservoir pressure, produces the mobility of the oil desired.

Unexpectedly, when the oxygen content of the effluent gas exceeds 3%, the mobility of the oil is drastically reduced, the oxidation reaction becomes quite inefficient and insufficient carbon dioxide is produced to assist in mobilizing the oil.

Consequently, when the gas analysis means indicates a condition of greater than 3% oxygen by volume in the effluent gas removed from the well the oil and gas in the well is ignited in accordance with known techniques. Such additional oxidation reduces the oxygen content of the effluent gas to less than 3%, produces additional carbon dioxide and increases the mobility of the reservoir oil.

One additional method which can be used to control the oxidation reaction is a reduction in the volume of air injected into the well when the gas analysis means indicates that the volume of oxygen in the effluent gas is greater than 3%. This results in an increase in reaction time between the injected air and the carbonaceous materials in the formation thus decreasing the oxygen content of the effluent gas and increasing the percent volume of carbon dioxide produced.

The particular pressure of 500 p.s.i.g. is believed necessary to obtain the beneficial effects of the pressure drive towards the producing well, as well as to provide the desired mobility of the oil. The pressure may be increased considerably above the stated 500 p.s.i.g. and still obtain the beneficial effects of the process. Pressures below 500 p.s.i.g. result in increases in oil viscosity and also result in an increase in the amount of formation gas liberated per barrel of oil produced. The increase in the amount of liberated gas at pressures lower than 500 p.s.i.g. result from the gas being released from solution with the reservoir oil.

As a typical example of the process, four producing wells may be located in spaced relation on a 40-acre producing site with the spacing defining a quadrilateral. One or more air injection wells are located at the center of the site. The oil sands producing the oil for the production wells are located at a depth of approximately 3200 feet. Air is injected into the injecting well or wells 10 at a well head pressure of approximately 1500 p.s.i.g. and at a volume of approximately one quarter of a million cubic feet per day. This produces a reservoir pressure of approximately 600 p.s.i.g. The pressure drop occurs because of the rather impermeable reservoir rock. The reservoir working pressure is controlled by adjusting gas flow from the casing 15 to produce the desired p.s.i.g. Pressure testing techniques such as sonic fluid level tests may be necessary to adjust surface casing pressure to reservoir pressure. A gas analyzer, as diagrammatically indicated in the drawing, is used to periodically measure the oxygen content in the effluent gas. If the oxygen content is above the stated 3% maximum level, the formation adjacent to the injection well 10 may be ignited in accordance with known fire flood techniques so as to produce carbon dioxide as a product of combustion of the oil and gas underground and reduce the oxygen content below 3%.

I claim:

1. The method of secondary recovery of oil from a reservoir including the steps of injecting air in a reservoir at a point spaced from a production well, maintaining the volume and pressure of the injected air so that a reservoir pressure of at least 500 p.s.i.g. is maintained, causing oxidation of reservoir material which results in the production of an effluent gas containing oxygen and carbon dioxide, reducing the surface tension of said oil in the reservoir by dissolving the carbon dioxide in the reservoir oil to render the high-gravity, paraffin-base oils more mobile and susceptible of being driven to the production well, keeping the dissolved carbon dioxide in the oil by maintaining said pressure and volume of the injected air, controlling the oxygen content of said effluent gas to a level of less than three percent by volume, withdrawing said effluent gas and oil separately from the production well.

2. The method of claim 1 wherein the effluent gas is produced by auto-oxidation.

3. The method of claim 1 wherein the percent volume of oxygen in the effluent gas is controlled through control of volume of the injected air.

4. The method of claim 1 wherein said carbon dioxide is also produced by ignition and combustion of the reservoir adjacent to the point of air injection whenever auto-oxidation of the oil in the reservoir is insufficient to maintain the oxygen content of the effluent gas to a level of less than three percent by volume.

5. The method of claim 1 wherein said effluent gas is recycled through the reservoir.

* * * * *